US005246614A

United States Patent [19]

Baumgartner et al.

[11] Patent Number: 5,246,614

[45] Date of Patent: Sep. 21, 1993

[54] COLORED EXTRUDED SOAP BARS

[75] Inventors: Erika M. Baumgartner, Freeport; Philip Greenberg; Harold A. Miller, both of White Plains, all of N.Y.

[73] Assignee: The MEARL Corporation, Ossining, N.Y.

[21] Appl. No.: 744,986

[22] Filed: Aug. 14, 1991

[51] Int. Cl.[5] ..... C11D 17/04; C11D 9/08; C11D 9/20; C11D 13/08

[52] U.S. Cl. ..... 252/133; 252/134; 252/174; 252/DIG. 16; 106/477

[58] Field of Search ..... 252/134, 174, DIG. 16, 252/133; 106/477

[56] References Cited

U.S. PATENT DOCUMENTS 3,832,431 8/1974 Matthaei ..... 252/134 X
3,874,890 4/1975 Bernhard et al. ..... 106/418
4,584,126 4/1986 Joshi ..... 252/DIG. 16 X
4,879,063 11/1989 Wood-Rethwill et al. .... 252/134 X

OTHER PUBLICATIONS

Kirk-Othmer, *Encyclopedia of Chemical Technology*, 3rd ed. (1982), John Wiley & Sons, Inc, NY, pp. 788-871.

Gardner, W. et al., *Chemical Synonyms and Trade Names*, 8th ed. (1978), Oxford Technical Press, Ltd., Oxford, England, p. 474.

*Primary Examiner*—W. J. Shine
*Assistant Examiner*—Douglas J. McGinty
*Attorney, Agent, or Firm*—Ostrolenk, Faber, Gerb & Soffen

[57] ABSTRACT

Soap bars are prepared by mixing a soap base with a metal oxide coated mica pearlescent pigment, that is strongly colored, or alternately with the colorant added separately to the soap base, so that the soap bars are brightly colored.

12 Claims, No Drawings

COLORED EXTRUDED SOAP BARS

BACKGROUND OF THE INVENTION

The great majority of soap bars on the market are made by extrusion of a soap base formulation. These soap bases are generally opaque due to two factors, first, the crystallinity of the chemical composition of the soap base, and second, the presence of pigmentary titanium dioxide. When a translucent soap is made, the base formulation does not contain the added pigmentary titanium dioxide and, further, it is modified by the addition of small amounts of polyhydroxy compounds so as to increase the transparency.

Pearlescent pigments have been used in extruded soap bars to effect certain appearance effects and a translucent soap base is desirable for that purpose. Japanese patent publication 54-26807 describes extruded soap bars having a pearly gloss and a wood grain appearance, but not with a bright color.

U.S. Pat. No. 4,584,126 is concerned with transparent soaps of a particular composition and processes for manufacture thereof. A process is described for making the translucent soap bars pearlescent in appearance by the incorporation in the formulation of small amounts of mica or of pearlescent pigments. However, this approach is not particularly successful for several reasons. First, mica is too close in refractive index to the soap base to impart significant pearlescent reflectivity. Second, the soap base physical structure is such as to inhibit the orientation of the platey pigment particles into parallel layers. Moreover, there is no suggestion of the use of pearlescent pigments in extruded soap bars to achieve various attractive color effects, as distinct from pearlescent effects alone.

Copending patent application, Ser. No. 617,544, filed Nov. 26, 1990, describes extruded soap bars having an improved wood grain appearance. Such extruded soap bars are not brightly colored.

While extruded soap bars with color are common and numerous, they are dull or matte in appearance and very limited in the choice of colors. These unattractive features are due to the light scattering or coverage character of the conventional colorant pigments. Also, because most organic colorants are not stable in the alkaline medium of extruded soap base formulations, the choice of colorants is very limited.

Further, when dyes are used in extruded soap bar formulations, they can bleed badly when the soap is wet in use. In fact, most pigmentary colorants also bleed badly in wet use.

The presence of a pearlescent pigment in an extruded soap bar has, as noted above, been asserted to render the soap bar pearly in appearance. However, a pearlescent pigment incorporated in a transparent, or translucent, medium must have its flat and platey pigment particles oriented into parallel layers so that the incident light may be reflected in a specular manner to yield the pearly appearance. This optical behavior has been described many times, for example, in Nacreous Pigments, L. M. Greenstein, Encyclopedia of Polymer Science and Technology, Vol. 10, 1969, John Wiley & Sons, Inc., pp. 193–215.

It is, in fact, very difficult to achieve this high degree of two-dimensional orientation in extruded soap bars. The reason is at least in part due to the structure of the soaps, which had been found many years ago to be crystalline and subsequently it was recognized that soap bases consist largely of liquid crystals. Using extrusion techniques on soap base formulations containing pearlescent pigments, it is possible to attain some limited orientation of the platey pigment particles, usually one-dimensional in the direction of the extrusion axis, but not two-dimensional for any distance. A uniform pearly appearance is not readily attained, except over small areas of 1–5 mm in distance.

It has now been found that the use of certain pearlescent pigments overcome the objections of conventional colorants presented above. Very significantly, these pearlescent pigments scatter light minimally, or have low coverage. As a consequence, the colored pearlescent pigment imparts color brightness to an extruded soap bar. Even with the limited orientation of the pearlescent pigment particles, a brightness and depth is obtained, which is not displayed by soap bars containing other types of pigments. With colored pearlescent pigments, this becomes a brightness of color.

It is an object of this invention to produce extruded soap bars having a brightness and clarity of color. This and other objects of the invention will become apparent to those skilled in the art from the following description.

SUMMARY OF THE INVENTION

This invention relates to extruded soap bars that show bright colors with clarity or intensity. Soap bars are prepared by mixing a soap base with a metal oxide coated mica pearlescent pigment that is strongly colored or, alternatively, with a colorant added separately to the soap base, so that the soap bars are brightly colored. More specifically, this is achieved by incorporating a pearlescent pigment which is either an organic absorption colorant containing $TiO_2$ coated mica nacreous pigment, or a colored metal oxide nacreous pigment or a black pigment in the soap base and using appropriate extrusion techniques to form the billets from which the soap bars are pressed.

DESCRIPTION OF THE INVENTION

Extruded soap bars are conventionally prepared by processing soap formulation containing the soap-forming components through an amalgamator, refiner, plodder, cutter, and press. The amalgamator and refiner primarily mix the components and make the soap formulation homogeneous. The plodder is essentially an extruder with a compression cone and plate from which an extruded soap is obtained in continuous form. The continuous extruded soap is then cut into appropriate lengths to approximate the desired bar size by the cutter, and the press is used to shape the soap into its final configuration.

Any of the usual soap-forming mixtures currently used to produce a translucent or opaque soap bar can be used in the present invention. It is preferred to use a translucent soap base formulation in the present invention because the resulting color appearance will be brighter and sharper. Opaque bases can be used, however, if free of pigmentary titanium dioxide.

The color effects in extruded soap bars, attainable by using appropriate pearlescent pigments, can be divided into three categories. The colored extruded soap bars show (1) dark colors by using a combination of an interference reflection pearlescent pigment and a black pigment, (2) intense colors from a combination of an absorption colorant and an interference reflection pearlescent pigment, both showing the same color, and (3) bright and clear colors from a pearlescent pigment, preferably with a highlight color different from the absorption color.

Dark colors of extruded soap bars can be obtained by using a pearlescent pigment, showing an interference reflection color, in combination with a black pigment. The latter can be a part of the pearlescent pigment or added separately. Carbon black is the most convenient black pigment. The presence of the black pigment causes the transmission color of the interference color pearlescent pigment to be totally absorbed so that only the interference reflection color of the pearlescent pigment is seen, resulting in the dark color appearance.

The black pigment can be added as an integral part of the pearlescent pigment or as a separate component. The black pigment is not limited to carbon black, and pearlescent pigments which contain black metal oxides as partial or total coatings on mica can be used. These include black iron oxide ($Fe_3O_4$), ilmenite ($FeTiO_3$), manganese dioxide, and other readily available and non-toxic black pigments. Alternately, these materials can be added separately from the pearlescent pigment.

The second category of colored extruded soap bars, showing intense colors, contain a pearlescent pigment that has an absorption colorant in its composition and an interference reflection color, the two colors being the same, and in this way, reinforcing each other and intensifying the color. The best pigments for this purpose are titanium dioxide coated mica pigments in which the titanium dioxide coating thickness displays a particular interference reflection color and also contains an absorption colorant which has the same color as the interference reflection color. Alternately, but not preferably, the absorption colorant can be added separately from the pearlescent pigment.

While many different organic colorants can be used to obtain the color effects in extruded soap bars, most are unsatisfactory in stability, particularly in the alkaline medium of the soap base. For example, colorants of U.S. Pat. No. 4,968,351 used to coat titanium dioxide coated mica pearlescent pigments, are not sufficiently stable, and these laked colorants are limited in application in extruded soap bar formulations.

Most advantageous absorption colorants for this purpose are those of U.S. Pat. No. 4,755,229. These absorption colorants are extremely stable and inert, and they can be used as the absorption colorant components of the pearlescent pigments for the purpose of this invention. Preferably used are phthalocyanine blue, phthalocyanine green, quinacridone red and carbazole violet. Also, absorption colorants similar in structure or chemistry can also be used, as well as others of equal or similar stability properties.

The use of a pre-formed pigment in which the absorption colorant is part of the pearlescent pigment is very advantageous. The absorption colorant is in the form of a thin coating on the titanium dioxide coated mica surface, and the color intensity is high for a very low concentration of the absorption colorant in the soap formulation. It is a very efficient way of obtaining a maximum color appearance with a minimal absorption color concentration. The absorption colorant concentration in the pearlescent pigment is generally in the range of about 0.1–5%, and preferably about 0.25–2.5%.

The third category of extruded soap bars are those showing bright and clear colors in which the highlight color is different from the absorption color. This is achieved by using pearlescent pigments in which the interference reflection color is different from the absorption color of the pearlescent pigment.

Such complex pearlescent pigments consist of a metal oxide coated mica in which the metal oxide thickness is such that a particular interference reflection color is displayed, as well as an absorption colorant as part of the coating on the pigment platelets, the absorption color being different from the interference reflection color.

The absorption color can originate in the metal oxide coating on the mica in which the titanium dioxide used is replaced in part or entirely by metal oxides which are absorption colorants. These include ferric oxide ($Fe_2O_3$), chromium oxide ($Cr_2O_3$), manganese oxide, and cobalt oxide.

While these metal oxides as absorption colorants are very stable and inert, they are limited in brightness and colors, and very bright and interesting absorption colors are available with absorption colorants which are organic compounds. Most stable and most suitable are those that are stable in alkaline media, as mentioned above and include phthalocyanine blue, phthalocyanine green, quinacridone red and carbazole violet, and chemically related colorants. (This means quinacridone violet as well as quinacridone red, and phthalocyanine green subgroups with variable chlorination of the aromatic rings.) Titanium dioxide is the metal oxide coating of choice.

The use of pre-formed pigment in which the pearlescent pigment contains the absorption colorant is very advantageous. The absorption color intensity is high for the very low concentration of the absorption colorant is a thin coating on the titanium dioxide coated mica pigment platelet surface. The absorption colorant concentration in the pearlescent pigment is in the range of about 0.10–5%, and preferably about 0.25–2.5%.

The titanium dioxide coated mica pigment and the absorption colorant can be added separately to the soap formulation, but this method is disadvantageous by comparison, as somewhat better soap bar appearance is achieved with the preformed combination pearlescent pigment, even beyond the ease of dispersion of the single pigment component. Moreover, the complex pigment containing the absorption colorant in its structure is far superior to the mixture of pigments in reduced color bleed behavior.

The colored pearlescent pigments are used in the soap formulation at a concentration range of about 0.1–5%. The average particle size is usually in the range of about 5 to 80$\mu$ and preferably about 6 to 50$\mu$, and most preferably about 8 to 40$\mu$.

The preferred amounts of pearlescent pigments in the soap formulation are a function of the desired effect. For the combination nacreous pigments, this is best stated in terms of the absorption colorant concentration. In the case of a bright color soap bar, the absorption colorant concentration should be in the range of 0.002 to 0.01% with the weaker or lower color value colorants such as quinacridone red and quinacridone violet being present preferably in at least about 0.005%. In the case of a deeply colored soap bar, the color intensity of the absorption colorant can be enhanced by employing an interference containing dioxide coated mica which has the same interference reflection color as the color of the absorption colorant. In this instance the absorption colorant should be in a concentration range of 0.005% to 0.025% with the quinacridone red and related types preferably being at the higher end of this range. When the extruded soap bar is desired to be darkly colored and the combination is used, the amount of the interference nacreous pigment is about 0.05% to 5%, preferably about 1 to 3%, and the concentration of black pigment is about 0.01 to 1%. When the black pigment is carbon black, the preferred amount is 0.01 to 0.4%, depending to some extent on the color intensity of the particular grade of carbon black employed. If the black pigment is black iron oxide, the concentration should be about 5 to 10 times higher than that for carbon black, or 0.1 to 5%. If other black pigments are used, such as ilmenite or manganese dioxide or other, then about 3 to 6 times the concentration of that of carbon black is appropriate.

Beyond the particular pigment used, it is necessary to achieve a degree of uniaxial orientation of the platey pigment particles, which yields brighter and cleaner colors. The degree of orientation required can vary widely and depends on the soap base formulation, pigment, concentrations of ingredients and desired effect. The appropriate degree can easily be determined by a few preliminary experiments. To achieve the orientation, the soap formulation is extruded through a perforated plate near the exit end of the plodder, usually situated between the worm gear and the cone. This perforated plate can have holes that range from small to large and in any shape such as circular, elliptical, triangular, or square, as long as it induces the orientation of the platelets. As a practical matter, the shapes of these holes are not significant, and for convenience they can be circular or square, both being easy to form.

The size of the holes can be from 0.3 mm diameter or width up to 5 mm or even larger. However, the smaller sizes such as 0.3–0.6 mm cause a greater back pressure during extrusion and slow up the production rate without having any orientation advantage on the platey pearlescent pigment particles compared to plates with larger holes. The open area of the plate depends upon the pattern to be obtained in the soap bar, and it can vary from about 20 to 60%, preferably about 25–55%.

The following are various examples to illustrate the invention. These examples are not intended as limitations. All parts and percentages are by weight unless designated otherwise, and all temperatures are in degrees Centigrade.

Example 1 - Extruded soap bar with bright pink appearance

A translucent soap base formulation in the form of chips containing 83% anhydrous soap, 4% glycerine and 13% moisture, 987 grams, was combined with 10 grams of fragrance and 3 grams of a pearlescent pigment of high luster, red absorption color, gold interference reflection color having an average platey pigment size of 22 microns and the following approximate composition: 64.0% mica, 33.5% titanium dioxide, and 2.5% quinacridone red.

The mixture was first amalgamated using the amalgamator portion of a 7.62 cm Simplex Mazzoni Soap Extruder. The mixture was then refined by being passed twice through a Mazzoni Laboratory Plodder, which is essentially an extruder having a 3-inch (ca. 7.6 cm) inside diameter. The plodder was fitted with a screen with 1 mm diameter holes.

The plodder was then fitted at the end of the extrusion screw with a perforated worm support plate having incomplete sections of circles with the following dimensions, 7.9 cm outside diameter, 0.7 cm width of air spaces of truncated circles, 0.6 cm width of metal portions between air spaces, 2.0 cm diameter center hole, and 0.7 cm thickness of the plate. The compression nozzle was heated to about 50° C., and the extruded rectangular soap log was cut into billets of appropriate length, which were then pressed into soap bars of approximate dimensions of 5 cm×3.2 cm×1.4 cm.

The finished soap bars have a bright pink appearance, a gold reflection color at certain angles, some translucency and brightness, and a few small areas of pearly reflection. In use, or after wetting with water, the soap bars show only slight bleeding of the pink color.

After some use, a bar in this example shows no significant change in general appearance, and the color is stable. Upon aging of a dry bar for one year, no significant change in color is perceptible.

Example 2 - Extruded pink soap, comparison with Example 1, with change in the soap base formulation to an opaque type Chips of an opaque base containing 86% anhydrous fatty acid solution soap, 1% glycerine, and 13% water (but no pigmentary titanium dioxide) were employed. The anhydrous soap portion of the chips contained 15% coconut fatty acid sodium soap and 85% hydrogenated tallow fatty acid sodium soap. The chips, 1000 grams, were combined with 10 grams of fragrance and 3 grams of the pearlescent pigment of Example 1.

The mixture was first amalgamated using the amalgamator portion of a 7.62 cm Simplex Mazzoni. The refining was carried out the same way as in Example 1. After the refining the plodder was fitted as in Example 1. The compression nozzle was heated to a higher temperature, about 75° C., for this soap formulated from an opaque soap base formulation.

After extrusion of the rectangular soap log, cutting into billets of desired length, and pressing into soap bars, the bars could be seen to have an appearance similar to those of Example 1, but with somewhat less brightness of color and less translucency. In particular, the gold interference reflection color could not be seen.

Example 3 - Extruded pink soap, comparison with Example 1, with change in the pigment added The translucent soap base formulation of Example 1 in the form of chips was used. 1000 grams were combined with 10 grams of fragrance and 3 grams of pigment consisting of the following two components: 2.925 grams of $TiO_2$ coated mica (Flamenco Gold-about 65% mica and 35% titanium dioxide; 22 μm average platey pigment particle size; The Mearl Corporation) and 0.75 gram of quinacridone red pigment. These two pigments together have the same composition and amounts as the complex pigment used in Example 1.

The soap bars are prepared in exactly the same way as those done in Example 1, starting with the same translucent soap base formulation and following the same procedure.

The final soap bars have a pink color and appearance similar to those in Example 1, but somewhat diminished in color intensity and translucency, and have no appearance of depth.

These soap bars were tested for color bleeding by using them wet with water for about 5 minutes, placing the flat surface of the bars on a white paper towel, and examining the paper towel after one hour. Considerable pink color had migrated to the paper towel, approximately 4–5 times as much as was seen by testing the soap bars of Example 1 in the same way.

Example 4 - Extruded soap bar with a turquoise color

The translucent soap base of Example 1, 970 grams, was combined with 20 grams of fragrance and 10 grams of pearlescent pigment of high luster, green absorption color, and blue interference reflection color. The rutile $TiO_2$ coated mica pigment had the following composition: 46% mica, 53% titanium dioxide, 0.5% stannic oxide, and 0.5% phthalocyanine green and had an average platey pigment size of about 18 μm.

The mixture was treated in the same way as in Example 1 to prepare the soap bars. The extrusion was carried out with a worm support plate with incomplete sections of circles with the following dimensions, 7.9 cm outside diameter, 0.7 cm width of air spaces of truncated circles, 0.6 cm width of metal portions between air spaces, 2.0 cm diameter center hole, and 0.7 cm thickness of the plate.

The soap bar had a beautiful blue-green color, very small and minor striations, and was very close in color to that of a small sample of turquoise mineral.

Example 5 - Extruded soap bar with dark blue color 1000 grams of a translucent soap base formulation, similar to that used in Example 1, were combined with 10 grams of fragrance, and 1 gram of a 20% grind of carbon black in mineral oil. This mixture, after amalgamation, was refined by passing it through the Mazzoni twice fitted with a screen with 1 mm diameter holes.

Then, 20 grams of the interference pearlescent pigment, Flamenco Super Blue (The Mearl Corporation), were added to the soap base mixture. The approximate composition of this pigment is 52% mica, 7% titanium dioxide, and 1% stannic oxide, and the average particle size is about 19 microns.

The resulting soap base mixture was subjected to further refining by passing it through the Mazzoni fitted with a screen with 1 mm diameter holes, followed by an additional pass using a screen with 0.5 mm diameter holes.

The extrusion was carried out with the Mazzoni fitted with a large worm support plate that is slotted, the slots in the vertical position, and a perforated disc with 2 mm diameter holes.

After extrusion of the soap log, cutting into billets, and pressing of the soap bars, dark blue bars were obtained that showed black lines of variable width in the longitudinal direction.

These soap bars were tested for wet bleeding and they showed virtually none. Soap bars of dark colors with virtually no bleeding have not been made successfully by other methods.

Example 6 - Extruded soap bar showing soft and translucent pink color with blue highlights 1000 grams of a translucent soap base formulation as in Example 1 was used. The soap base was combined with 20 grams of fragrance and 5 grams of a pearlescent pigment which showed a red absorption color and a blue interference reflection color. The pearlescent pigment consisted of about 46% mica, 53% titanium dioxide, 0.5% stannic oxide, and 0.5% quinacridone red, and the average pigment particle platelet had an average length of 18 microns.

The mixture was first amalgamated and then subjected to refining in a Mazzoni Laboratory Plodder by first passing the material through a screen having 1 mm diameter holes. This was followed by passage through a screen with 0.5 mm diameter holes.

The extrusion was carried out with a worm support plate as described in Example 2, having truncated circular openings. The extruded soap log was cut into billets of approximate length and subsequently pressed into soap bars.

The bars had a smooth appearance with a soft pink color and light blue highlights.

Example 7 - Extruded soap bars with deep blue color

A translucent soap base formulation as used in Example 1, 976 grams, was amalgamated with 20 grams of fragrance and 4 grams of a pearlescent pigment showing a blue color. This pigment had an approximate composition of 46% mica, 51% titanium dioxide, 2.5% phthalocyanine blue, and 0.5% stannic oxide, and the average length of the pigment platelets was 18 microns.

The refining was carried out in the Mazzoni, fitted first with a screen with 1 mm diameter holes, and the mixture was passed through this screen twice. An additional refining step was carried out with a screen of 0.5 mm diameter holes; this additional fine refining provided for a very intimate mixing of the colored pigment in the soap base.

The extrusion was carried out with a worm support plate as described in Example 2, having truncated circular openings. The soap bars that were obtained showed a deep blue color with almost no longitudinal pattern. The latter was the result of the extensive refining of the amalgamated soap base mixture plus the pattern of the worm support plate. Pearliness was not a characteristic of this soap bar. This bar showed a very low level of bleeding of the blue color in a test with water.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A colored soap bar comprising a translucent soap base containing uniaxially oriented colored pearlescent pigment said pigment comprising titanium dioxide coated mica and an absorption colorant.

2. The colored soap bar of claim 1, wherein in the colored pearlescent pigment the color of the absorption colorant is different from the reflection color of the titanium dioxide coated mica.

3. The colored soap bar of claim 1 in which the colored pearlescent pigment has a particle size of about 5 to 80 mm and is present at a concentration of about 0.1 to 5%.

4. The colored soap bar of claim 1 in which the colored pearlescent pigment is a preformed combination nacreous pigment comprising titanium dioxide coated mica and about 0.1 to 5% alkaline stable, inert absorption colorant having the same absorption color as the reflection color of the coated mica.

5. The colored soap bar of claim 4 wherein said absorption colorant is selected from the group consisting of phthalocyanine blue, phthalocyanine green, quinacridone red and carbazole violet.

6. The colored soap bar of claim 5 in which the absorption colorant is 0.1 to 5% of the colored pearlescent pigment.

7. The colored soap bar of claim 6 in which the absorption colorant is 0.25 to 2.5% of the colored pearlescent pigment.

8. The colored soap bar of claim 1 which contains a black pigment.

9. The colored soap bar of claim 8 in which said black pigment is selected from the group consisting of carbon black, black iron oxide, ilmenite and manganese dioxide.

10. The colored soap bar of claim 9 in which the black pigment is carbon black.

11. The colored soap bar of claim 10 in which said pearlescent pearlescent pigment comprises an absorption metal oxide colorant coated mica.

12. The soap bar of claim 11 in which the absorption metal oxide colorant is selected from the group consisting of ferric oxide, chromium oxide, manganese oxide and cobalt oxide.

* * * * *